United States Patent [19]

Martin

[11] Patent Number: 4,748,797

[45] Date of Patent: Jun. 7, 1988

[54] PACKAGING METHODS AND APPARATUS

[75] Inventor: David Martin, Hamilton, New Zealand

[73] Assignee: Trigon Packaging Systems (NZ) Limited, Hamilton, New Zealand

[21] Appl. No.: 902,296

[22] Filed: Aug. 29, 1986

[30] Foreign Application Priority Data

Aug. 30, 1986 [NZ] New Zealand ..... 213316

[51] Int. Cl.[4] ..... B65B 31/02

[52] U.S. Cl. ..... 53/432; 53/510; 83/404.1; 83/408; 198/803.2

[58] Field of Search ..... 53/432, 281, 433, 509, 53/510, 511; 83/404.1, 408; 198/465.1, 465.3, 803.01, 803.2

[56] References Cited

U.S. PATENT DOCUMENTS

| | | | |
|---|---|---|---|
| 3,283,469 | 11/1966 | McBrady et al. | 53/432 |
| 3,553,931 | 1/1971 | Rorer | 53/509 |
| 3,673,760 | 7/1972 | Canamero et al. | 53/433 |
| 3,709,702 | 1/1973 | Mahaffy et al. | 53/433 X |
| 3,762,251 | 10/1973 | Madsen et al. | 83/408 X |
| 3,990,336 | 11/1976 | Soodalter | 83/408 X |
| 4,058,953 | 11/1977 | Sanborn, Jr. et al. | 53/433 |
| 4,229,927 | 10/1980 | Dag | 53/511 X |
| 4,624,099 | 11/1986 | Harder | 53/432 |

*Primary Examiner*—Robert L. Spruill
*Assistant Examiner*—Steven P. Weihrouch
*Attorney, Agent, or Firm*—Abelman Frayne Rezac & Schwab

[57] ABSTRACT

A packaging method and apparatus are disclosed in which a substantially horizontal bed is loaded with a series of independent magazines. Each of the magazines supports a plurality of open trays which are loaded with the desired contents. The magazines are moved along the bed to a vacuum chamber where a cover film is applied and the magazines are independently supported. The vacuum chamber is then closed to allow for evacuation and sealing of the covered trays and the magazines supporting the finished packages are removed from the vacuum chamber.

19 Claims, 7 Drawing Sheets

PACKAGING METHODS AND APPARATUS

FIELD OF THE INVENTION

This invention relates to vacuum packaging methods and apparatus.

BACKGROUND OF THE INVENTION

It is known to provide vacuum packaging apparatus having one or two vacuum chambers to which differential pressures are used for the purpose of evacuating and hermetrically sealing a package. Examples of this type of apparatus are described in U.S. Pat. Nos. 3,491,504 (Young), 3,835,618 (W. R. Grace), and 4,480,425 (Furukawa).

The present invention has particular relevance to tray (as opposed to trayless or bag packaging systems) where articles to be packed are first placed in a tray or trays in a vacuum chamber, the chamber and packages evacuated, a film is applied to the tray or trays and the vacuum chamber pressures are raised so that the heated film adheres to the tray or trays and/or product in the tray.

Where a number of trays are to be filled, a pallet of the trays is first placed in a magazine, they are then filled with product and then placed in the vacuum chamber where the packages are evacuated and the film applied over the top of the trays. When the trays leave the vacuum chamber they are cut into individual packages by cutting apparatus.

The cutting or slitting of the trays from the magazine into individual elements is an operation presently achieved manually or by a separate machine.

SUMMARY OF THE INVENTION

It is a broad object of the present invention to provide an improved method of packaging and an apparatus for carrying out the method.

Further objects and advantages of the present invention will become apparent from the ensuing description which is given by way of example.

According to the present invention, there is provided a method of packaging comprising the steps of sequentially:

(a) loading a bed which is disposed on a substantially horizontal plane with a series of magazines each of said magazines providing adjacent rows of pockets defined by ridges over which a preformed or formable package base can be supported, (b) loading the magazine, (c) advancing the magazines into a vacuum chamber whilst simultaneously applying a film over the advancing magazine, (d) evacuating and sealing the package within the vacuum chamber so that a compartmental package is formed with elements of the package being separated by unity of the base to the film in a lattice formulation corresponding to the ridge formation of the magazine, (e) removing the magazine from the vacuum chamber and separating the elements of the package by cutting along the lattice formation whilst at the same time a newly loaded magazine enters the vacuum chamber.

According to a further aspect of the present invention there is provided an apparatus forming the aforesaid method, said apparatus comprising:

(a) a bed upon which a series of magazines may be transported through a horizontal plane, (b) driving means for driving the magazines on said bed and, (c) a vacuum chamber having an upper section and a lower section, support means for supporting magazines within the chamber said upper section being fixed and said lower section being reciprocable on a vertical plane towards and away from the upper section relative to the supporting member to form a sealed chamber with the upper section in which a package supported by said magazines can be evacuated and then sealed.

BRIEF DESCRIPTION OF THE DRAWINGS

Aspects of the present invention will now be described by way of example with reference to the accompanying drawings in which.

DESCRIPTION OF THE PREFERRED EMBODIMENTS

Figure 1:
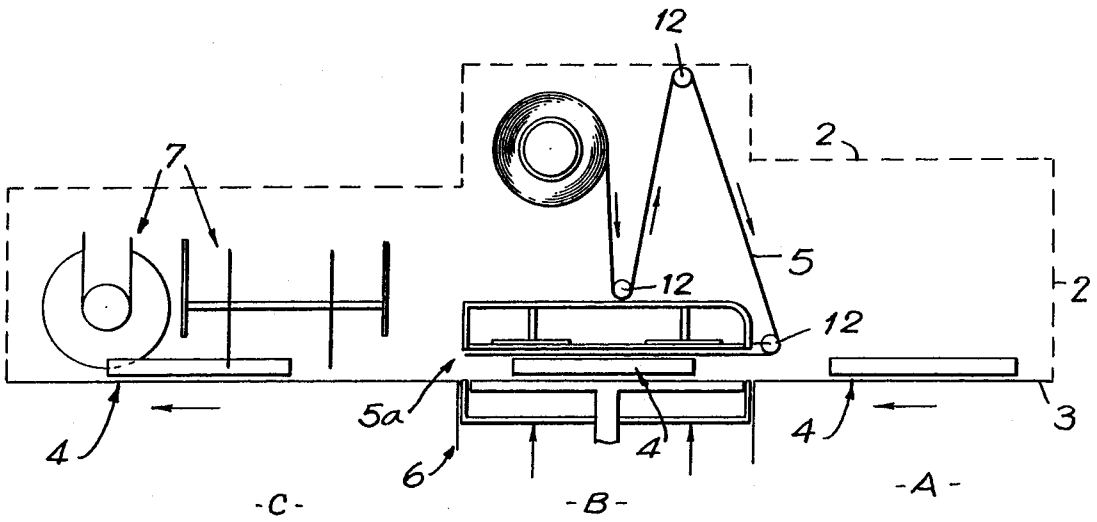
FIG. 1 is a diagrammatic side and partial sectional view showing the sequence of operation of packaging apparatus in accordance with the present invention.

With respect to the drawings and FIG. 1 initially, a vacuum packaging apparatus in accordance with the present invention generally indicated by arrow 1, is provided with a housing indicated by the broken line 2. A bed 3 is disposed on a substantially horizontal plane and the machine is arranged to automatically progress a plurality of magazines generally indicated by arrow 4, supporting products (not shown) through loading, evacuation and sealing and cutting operations as the magazines progress from right to left in the direction of the arrows as indicated. At position A, the magazines 4 are loaded by the placement of a preformed or formable package base thereon and the positioning of product to be packed on the package base. At position B a film 5 is applied over the magazine and the product and the package so formed is then evacuated and sealed within a vacuum chamber generally indicated by arrow 6. At position C the packaged product is released from the magazine by cutting means generally indicated by arrow 7.

Figure 2:
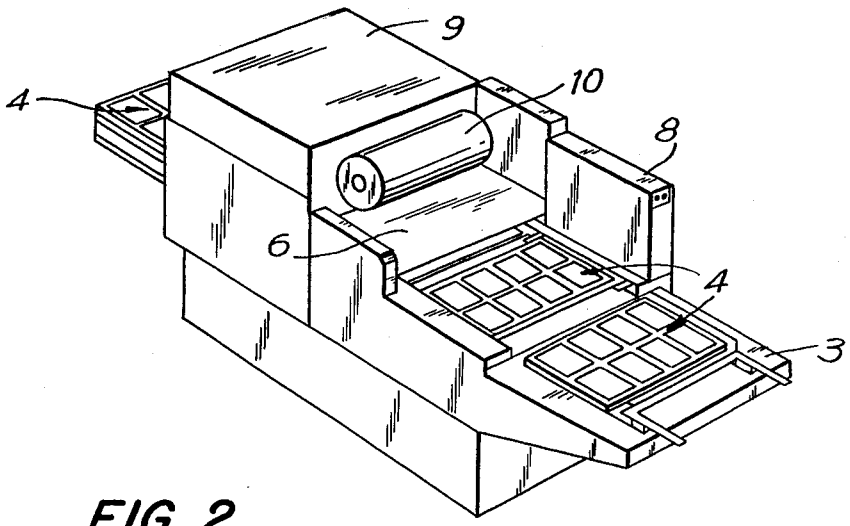
FIG. 2 is a perspective view of a packaging apparatus of FIG. 1.

FIG. 2 of the drawing illustrates the vacuum packaging apparatus in perspective. The magazines 4 are positioned and loaded on the bed 3 at a position adjacent a control console 8 for the machine, they then proceed to the vacuum chamber 6, and pass the cutters which are housed wtihin a cutter housing 9, and finally the packages are released from the cutter housing 9.

Figure 3:
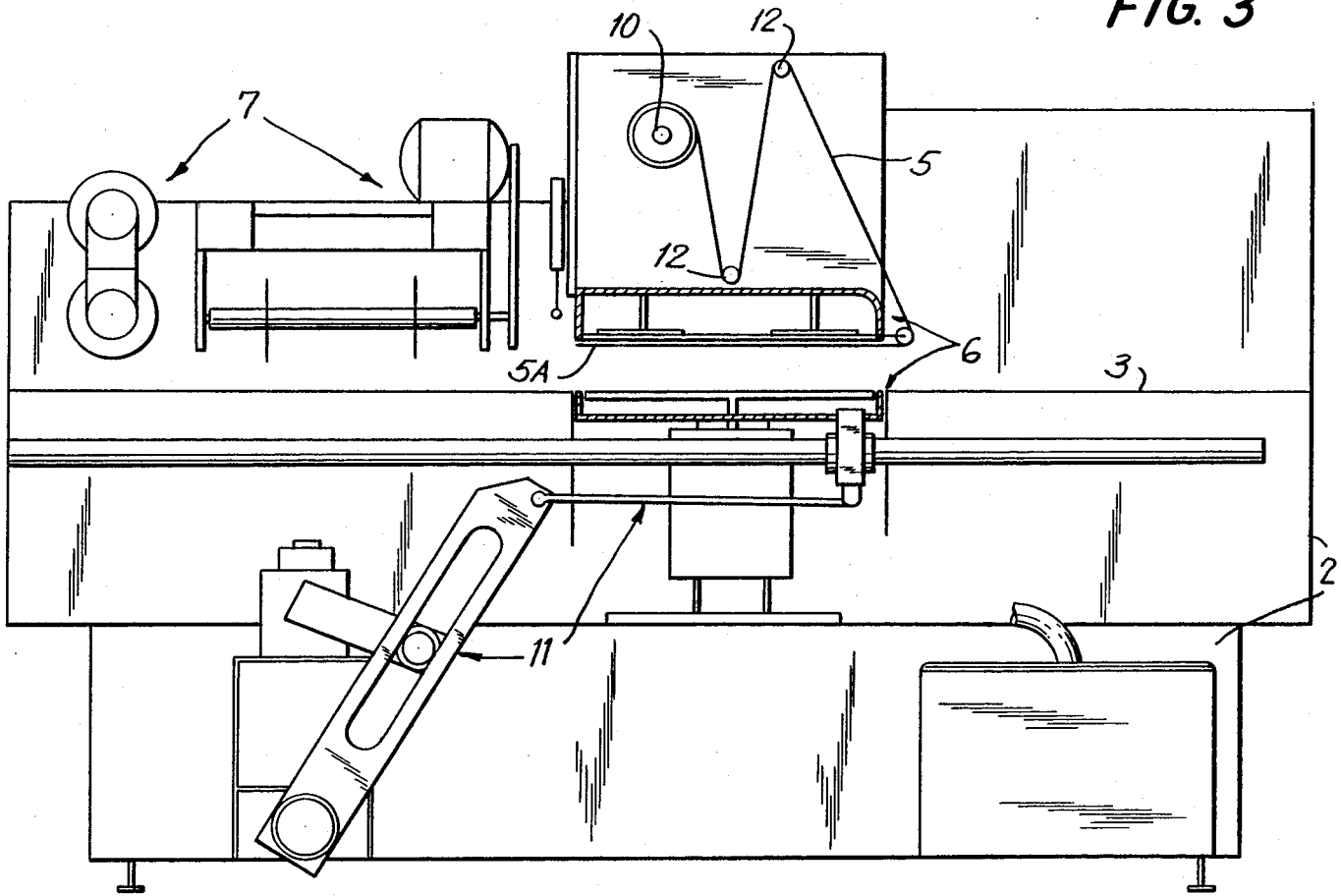
FIG. 3 is a side and partial sectional view of the apparatus of FIG. 1, and FIGS. 4, 4*a* & 4*b* are a series of sequential sketches showing the operation of the vacuum chamber for the packaging apparatus of the present invention.

FIG. 3 of the drawings illustrates in more detail the relationship between the cutting means 7, and the vacuum chamber 6 and also shows driving means generally indicated by arrow 11 for driving the magazines 4 over the bed 3.

Figure 5:
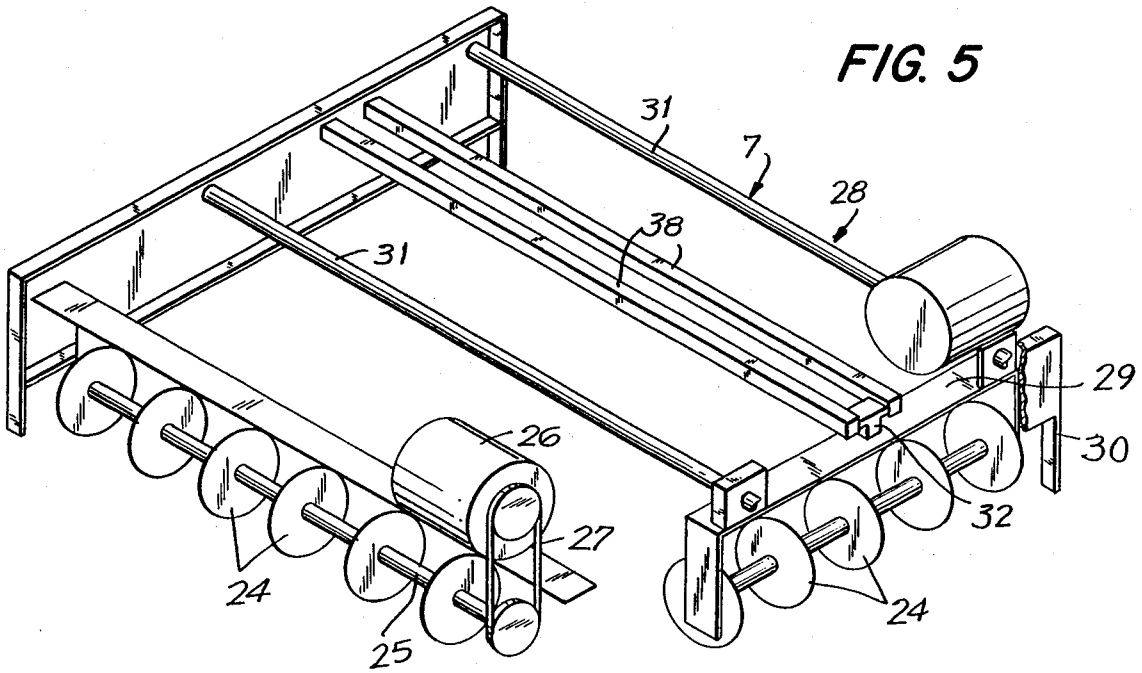
FIG. 5 is a perspective drawing of cutters for the packaging apparatus shown separated from the machine.
Figure 7:
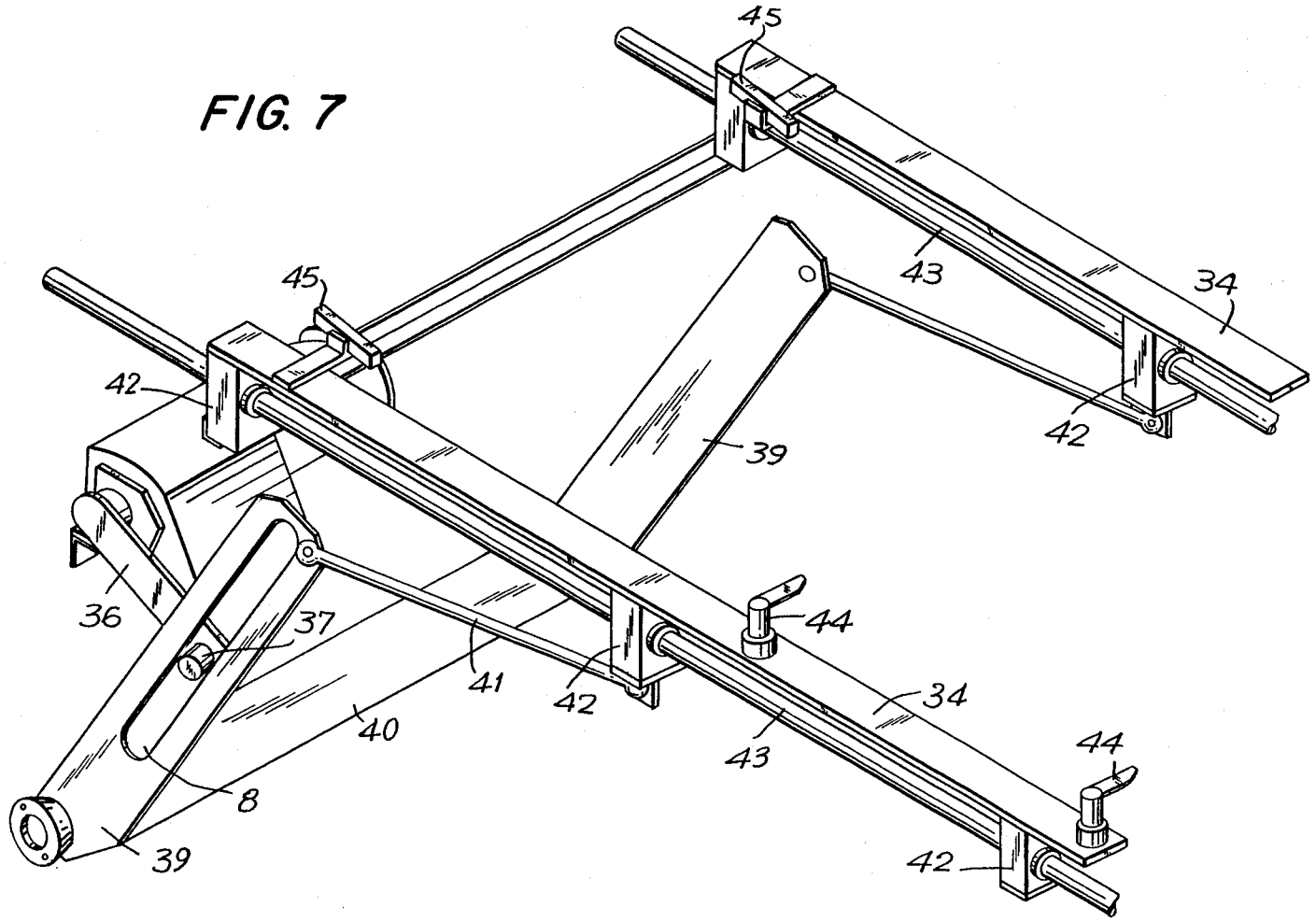
FIG. 7 is a perspective view of driving means for driving the pallet through the apparatus.

The cutting means 7 is prescribed in greater detail in relation to FIG. 5 and the driving means 11 are described in more detail in relation to FIG. 7.

Figure 4B:
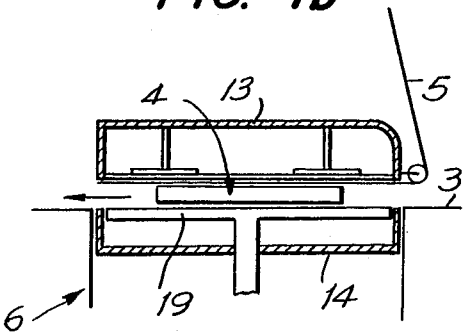
Figure 4A:
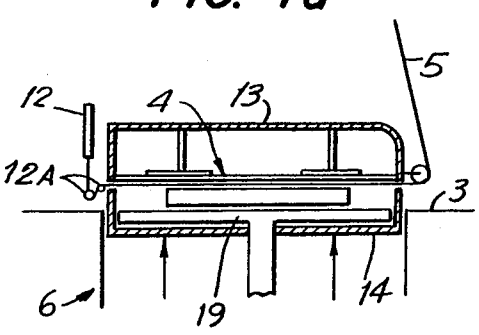
Figure 4:
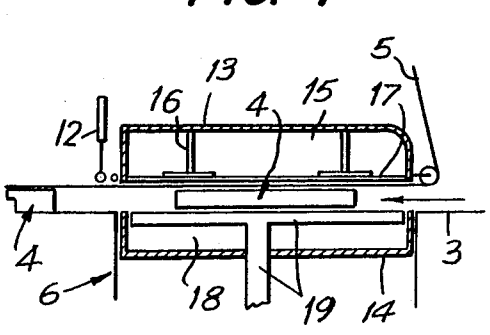

FIGS. 4, 4*a*, and 4*b* of the drawing illustrate the mode of operation for the vacuum chamber 6. The vacuum 6 comprises an upper fixed chamber 13 and a lower movable chamber 14. The lower chamber 14 is arranged to be moved relative to the magazine bed 3 and also with respect to the fixed upper chamber 13. The fixed upper chamber has an air space 15 and supports an apertured heater plate 17. The lower chamber 14 comprises an air space 18 and a support plate 19 for the magazine 4. FIG. 4 illustrates the introduction of a magazine 4 into the vacuum chamber 6 when the movable lower chamber 14 is in its lowered position and the support 19 has its upper surface in line with the magazine bed 3. A magazine 4 is introduced into the vacuum chamber in the direction of the arrow and at this stage the film 15 is held in tension over the magazine 4 by virtue of its connection to a magazine 4 which has just left the chamber 6. The lower chamber 14 is then closed on the upper chamber 13 as is illustrated by FIG. 4*a* and the packages supported by the magazine 4 are evacuated and sealed. This process involves the reduction of pressure within the closed chamber. On closure the film 5 is pinched between opposite edges of the upper and lower chambers and is in contact with the heater plate 17. As the lower chamber 14 arises a cylinder operated pressure bar 12 lowers, applies tension to the film 5 and the film contacts a hotwire 12A severing it from the previous magazine.

Chamber 6 is then repressurised so that the heated film 5 is brought into contact with the product on the magazine and adheres thereto. When the vacuum chamber 6 is opened as illustrated by FIG. 4*c* by movement away of the lower chamber 14 from the upper chamber 13, the magazine is removed from the vacuum chamber and a new loaded magazine takes its place. The removed magazine then proceeds to the cutting means 7. Some magazines may be shallower than others and to make up for any slight difference packers (not shown) can be positioned between the underside of the support 19 and the base of the lower chamber 14.

Figure 6:
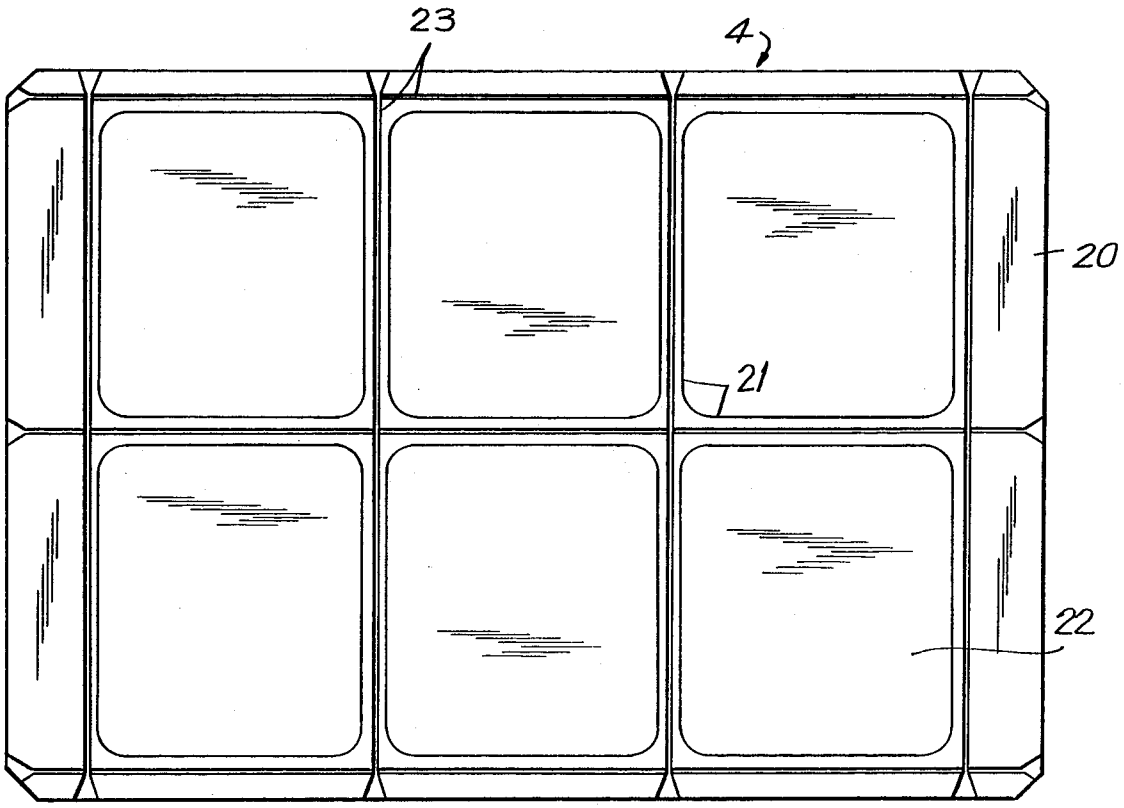
FIG. 6 is a plan view of a magazine for use with the apparatus of the present invention.

A typical magazine 4 is illustrated by the magazine 4 by FIG. 6. The magazine 4 comprises a frame 20 with parallel ridges 21 which define pockets 22. To load the magazine, a preformed semi-rigid package base (not shown) which is shaped to be complementary with the magazine can be placed over the magazine. The base may itself have pockets therein each of which is shaped to be complementary with the particular product to be packed and the pockets of the base coincide with the pockets 22 of the magazine. The ridges 21 are each provided with slots 23.

One form of cutting means 7 is shown by FIG. 5. The cutting means 7 comprises two sets of cutting blades disposed at right angles to one another, each of the cutting blades comprising cutting discs 24 mounted on a shaft 25 which is driven by an electric motor 26 via belt transmission 27. The spacing of the discs 24 is arranged to be the same as the spacings between the parallel slots 23 in the magazines 4. In the example illustrated by FIG. 5, a loaded magazine released from the vacuum chamber 6 approaches the cutting means in the direction of arrow 28. The loaded magazine is placed adjacent the first set of cutter discs so that the discs are aligned with the slots 23 in the magazine. The first set of cutter discs is arranged to be driven transversely across the prepositioned magazine and the next set of cutter discs is stationary. The first set of cutter discs are mounted on a movable carriage 29 supported by a frame 30 by rails 31. Between the rails 31 there is a piston drive (not shown) on slide 32 which is captured by guides 33. A pneumatic linear cylinder (not shown) can be used to drive the carriage 29.

During evacuation and sealing of the product within the vacuum chamber, the film and tray are sealed together in a lattice formation which corresponds with the ridge formation of the magazine upper surface which has been previously described. When the loaded magazine leaves the vacuum chamber and is progressed to the cutters, a transverse cut in the lattice is firstly made by the movable discs 24 as the carriage 29 is reciprocated and then a longitudinal cut is made by the second set of fixed discs. Use of the magazine illustrated by FIG. 6 would enabel six individual packages to be loaded, evacuated, sealed and separated by the cutters. It is to be appreciated of course the magazine may have any number of pockets with the only limit being the size of the vacuum chamber.

It is important that the magazine be progressed along the tray bed such that the progress of the magazines on the tray bed corresponds with the operational sequences of the apparatus. FIG. 7 of the drawings illustrates driving means 11 for the apparatus. The driving means 11 comprises sliding rails 34 positioned at either side of the magazine bed 3 at the loading end of the apparatus. The rails 34 are driven by a motor driven arm 36 which has at its free end a bearing 37 engagable in a slot 38 of an arm 39 of a pivotable U-shaped connecting arm 40. Each limb 39 of the arm 40 is connected by a connector rod 41 to one of several linear bearings 42 which support the rails 34. The linear bearings 42 are mounted on slide rails 43. The rails 34 mount matching pairs of pivotable fingers 44 and pushers 45 and magazines are loaded onto the magazine bed between the fingers 44 and pushers 45.

The action of the crank mechanism is such that as arm 36 revolves the position of the bearing 37 drives the arm 39 which is pivoted at 46 in a wiper action which translates into a forward and reverse motion for the rails 34 and thus magazines positioned relative to same. The crank drive is harmonic so that the forward motion when operational sequences are taking place is slower than the return motion. On the return the fingers 44 and pushers 45 are adapted to pivot in the reverse direction so that trays previously positioned on the bed 3 are not obstacles to the returning rail 34.

Aspects of the present invention have been described by way of example only and it will be appreciated that modifications and additions thereto may be made without departing from the spirit or scope thereof.

I claim:

1. A method of packaging comprising the steps of (a) loading a bed which is disposed on a substantially horizontal plane with a series of independent magazines, each of said magazines supporting a plurality of open packaging trays, (b) loading the trays, (c) advancing a magazine on said bed to a vacuum chamber, (d) independently supporting the said magazine within the vacuum chamber by providing support from beneath same, (e) applying a film over magazines within the vacuum chamber, (f) closing the vacuum chamber, (g) evacuating and sealing the trays supported by the magazine within the vacuum chamber, (h) removing the magazine from the vacuum chamber.

2. The method of claim 1, further including the steps of providing a magazine with adjacent rows of pockets defined by ridges over which a pre-formed package of trays can be supported evacuating and sealing the package within the vacuum chamber so that a compartmental package is formed with elements of the package being separated by unity of the base with the film in a lattice formation corresponding with the ridge formation of the magazine, and separating the elements of the package by cutting the lattice in a first direction and then cutting in a second direction at ninety degrees to the first direction.

3. Packaging Apparatus comprising (a) a bed upon which a series of magazines may be transported through a horizontal plane, (b) driving means for driving the magazine in said bed, (c) a vacuum chamber having an upper section and a lower section, the upper section being fixed and the lower section being reciprocal on a vertical plane towards and away from the upper section to form a sealed chamber in which a magazine supporting loaded packaging trays can be skin packaged, (d) fixed support means for supporting magazine within the chamber said support means providing an independent supporting surface for the magazines which is co-planar with said bed, (e) means for reciprocating said lower section on a vertical plane towards and away from said upper section, (f) supply means for feeding a top closure film between the fixed upper section of the vacuum chamber and a magazine supported by said support means, the arrangement being such that on entry of the magazine into the vacuum chamber and its positioning on said support means said means for reciprocating said lower section of the vacuum chamber can be activated to elevate the lower section of the vacuum chamber to a closed position.

4. Vacuum packaging apparatus as claimed in claim 3, including cutting means positioned in an outcoming side of the vacuum chamber and arranged to make transverse and longitudinal cuts to separate elements of the package on the magazine.

5. Vacuum packaging apparatus as claimed in claim 4, including a film supply source fixed adjacent the inward side of the vacuum chamber and adapted to supply continuously film to magazines passing through the vacuum chamber.

6. Vacuum packaging apparatus as claimed in claim 4, wherein the driving means comprises a crank arm which is connected to rail mounted driver blocks which push the trays along the tray bed at a first speed to the vacuum chamber and then at a slower speed from the vacuum chamber to the cutting means.

7. Vacuum packaging apparatus as claimed in claim 4, wherein the cutting means comprises a pair of cutters which are adapted to separated the elements of the package by making parallel cuts between them in a first plane in one direction and then in another direction on a second plane at ninety degrees to the first plane.

8. Vacuum packaging apparatus as claimed in claim 7, wherein the cutters are rotary cutters comprising a plurality of parallel cutting discs mounted on a common shaft said cutters being fixed in the path of the trays on the downstream side of the vacuum chamber and being reciprocal across the path of trays on the downstream side of the vacuum chamber.

9. Vacuum packaging apparatus as claimed in claim 8, wherein the driving means comprises a crank arm which is connected to rail mounted driver blocks which push the trays along the tray bed at a first speed to the vacuum chamber and then at a slower speed from the vacuum chamber means.

10. Vacuum packaging apparatus as claimed in claim 8, including a film supply source fixed adjacent the inward side of the vacuum chamber and adapted to supply continuously film to magazines passing through the vacuum chamber.

11. Vacuum packaging apparatus as claimed in claim 10 wherein the driving means comprises a crank arm which is connected to rail mounted driver blocks which push the trays along the tray bed at a first speed to the vacuum chamber and then at a slower speed from the vacuum chamber to the cutting means.

12. Vacuum packaging apparatus as claimed in claim 7 including a film supply source fixed adjacent the inward side of the vacuum chamber and adapted to supply continuously film to magazines passing through the vacuum chamber.

13. Vacuum packaging apparatus as claimed in claim 7 wherein the driving means comprises a crank arm which is connected to rail mounted driver blocks which push the trays along the tray bed at a first speed to the vacuum chamber and then at a slower speed from the vacuum chamber to the cutting means.

14. Vacuum packaging apparatus as claimed in claim 7 wherein the cutters are rotary cutters comprising a plurality of parallel cutting discs mounted on a common shaft said cutters being fixed in the path of the trays on the downstream side of the vacuum chamber and being reciprocable across the path of trays on the downstream side of the vacuum chamber.

15. Vacuum packaging apparatus as claimed in claim 14 including a film supply source fixed adjacent the inward side of the vacuum chamber and adapted to supply continuously film to magazines passing through the vacuum chamber.

16. Vacuum packaging apparatus as claimed in claim 14 wherein the driving means comprises a crank arm which is connected to rail mounted driver blocks which push the trays along the tray bed at a first speed to the vacuum chamber and then at a slower speed from the vacuum chamber to the cutting means.

17. Vacuum packaging apparatus as claimed in claim 3 including a film supply source fixed adjacent the inward side of the vacuum chamber and adapted to supply continuously film to magazines passing through the vacuum chamber.

18. Vacuum packaging apparatus as claimed in claim 17 wherein the driving means comprises a crank arm which is connected to rail mounted driver blocks which push the trays along the tray bed at a first speed to the vacuum chamber and then at a slower speed from the vacuum chamber to the cutting means.

19. Vacuum packaging apparatus as claimed in claim 3 wherein the driving means comprises a crank arm which is connected to rail mounted driver blocks which push the trays along the tray bed at a first speed to the vacuum chamber and then at a slower speed from the vacuum chamber to the cutting means.

* * * * *